US009982571B2

(12) United States Patent
Malinin et al.

(10) Patent No.: US 9,982,571 B2
(45) Date of Patent: May 29, 2018

(54) ARRANGEMENT AND METHOD FOR THE UTILIZATION OF WASTE HEAT

(71) Applicant: SIEMENS AKTIENGESELLSCHAFT, Munich (DE)

(72) Inventors: Vitaly Malinin, Moscow (RU); Viacheslav Schuchkin, Moscow (RU)

(73) Assignee: Siemens Aktiengesellschaft, München (DE)

( * ) Notice: Subject to any disclaimer, the term of this patent is extended or adjusted under 35 U.S.C. 154(b) by 13 days.

(21) Appl. No.: 15/024,488

(22) PCT Filed: Sep. 25, 2013

(86) PCT No.: PCT/RU2013/000833
§ 371 (c)(1),
(2) Date: Mar. 24, 2016

(87) PCT Pub. No.: WO2015/047120
PCT Pub. Date: Apr. 2, 2015

(65) Prior Publication Data

US 2016/0237859 A1 Aug. 18, 2016

(51) Int. Cl.

| | |
|---|---|
| ***F01K 3/18*** | (2006.01) |
| ***F01K 23/04*** | (2006.01) |
| ***F01K 25/10*** | (2006.01) |
| ***F01K 15/00*** | (2006.01) |

(52) U.S. Cl.
CPC ..... *F01K 25/103* (2013.01); *F01K 3/185* (2013.01); *F01K 15/00* (2013.01); *F01K 23/04* (2013.01)

(58) Field of Classification Search
CPC ..... F01K 3/185; F01K 15/00; F01K 23/04; F01K 25/103
See application file for complete search history.

(56) References Cited

U.S. PATENT DOCUMENTS

| | | | |
|---|---|---|---|
| 2008/0168290 | A1 | 7/2008 | Jobs et al. |
| 2012/0062442 | A1 | 3/2012 | Locker et al. |

(Continued)

FOREIGN PATENT DOCUMENTS

| | | | |
|---|---|---|---|
| DE | 10127998A1 | A1 | 1/2003 |
| WO | WO2011119650 | A2 | 9/2011 |
| WO | WO2012049259 | A1 | 4/2012 |

(Continued)

OTHER PUBLICATIONS

PCT International Search Report and Written Opinion of the International Searching Authority dated May 30, 2014 for corresponding PCT/RU/2013/000833.

*Primary Examiner* — Audrey K Bradley
(74) *Attorney, Agent, or Firm* — Lempia Summerfield Katz LLC

(57) ABSTRACT

The present invention relates to an arrangement (1) and method for the utilization of waste heat comprising at least a waste heat exchanger (3, 3', 3"), at least two turbines (6, 6', 6"}, at least two recuperators (7, 7', 7"), and at least a cooler unit (8, 9, 8', 9', 8", 9") in at least one fluid circuit. A pump and compressor (10, 10', 10") in one device is comprised, switchable between a pump and compressor function by a change of the rotational frequency of a rotor of the device.

22 Claims, 5 Drawing Sheets

(56) References Cited

U.S. PATENT DOCUMENTS

| | | | | |
|---|---|---|---|---|
| 2012/0131918 | A1* | 5/2012 | Held | F01K 3/185<br>60/645 |
| 2015/0330258 | A1* | 11/2015 | Eybergen | F01K 7/36<br>60/645 |

FOREIGN PATENT DOCUMENTS

| | | | |
|---|---|---|---|
| WO | WO2012074905 | A2 | 6/2012 |
| WO | WO2012074911 | A2 | 6/2012 |
| WO | WO2012074940 | A3 | 11/2012 |
| WO | WO2013115668 | A1 | 8/2013 |

* cited by examiner (STATE OF THE ART )

(STATE OF THE ART )

ARRANGEMENT AND METHOD FOR THE UTILIZATION OF WASTE HEAT

CROSS-REFERENCE TO RELATED APPLICATIONS

This application is the National Stage of International Application No. PCT/RU2013/000833, filed Sep. 25, 2013. The entire contents of this document is hereby incorporated herein by reference.

TECHNICAL FIELD

The present embodiments relate to an arrangement and method for the utilization of waste heat.

BACKGROUND

Organic Rankine Cycles (ORC) are used to utilize waste heat (e.g., from power generation, technological processes in metal manufacturing, glass production, chemical industry, from compressors, internal combustion engines, etc.). Conventional ORC technology is only able to use a certain amount of waste heat due to the limited thermal stability of organic fluids. Limited thermal stability of organic fluids limits the thermal efficiency of ORC systems if heat source temperature exceeds 250 to 300° C. On average, the total efficiency of ORC units, known from the state of the art, do not exceed values of 10%. Therefore, 90% of thermal energy is wasted to the atmosphere.

The use of Supercritical $CO_2$ (S—$CO_2$) cycles allows waste heat utilization with an efficiency of up to 20% in very compact systems. The size of the system is half of that using standard ORC technology. Compact systems may be used to utilize waste heat from different heat sources.

There are two basic system layouts for S—$CO_2$ cycles known from the state of the art (e.g., regenerative and non-regenerative). The two cycle systems differ from each other by the presence or absence of intermediate heating of cycle fluid by turbine exhaust gases in recuperators.

Both system layouts are used to utilize heat from sources with low power and temperature level with help of ORC and S—$CO_2$ cycles.

The internal thermal efficiency of regenerative cycles is almost twice as high as the efficiency of non-regenerative cycles. Regenerative cycles may exceed 30% for S—$CO_2$ cycle systems. However, in real conditions of S—$CO_2$ cycle implementation net efficiency, the rate of thermal to electrical energy conversion, for systems with simple layouts, is around 10% of total thermal energy supplied by the heat source. To improve the performance and achieve 20% efficiency, more complex system layouts are to be used.

S—$CO_2$ cycle implementation, depending on the environmental conditions and layout, may require both pumps for liquefied $CO_2$ flow and compressors for S—$CO_2$ gas compression. At real conditions, regenerative cycles have more than twice higher internal thermal efficiency than non-regenerative cycles and take less thermal energy from the heat source. Even for relatively low temperatures of heat sources, temperatures at the heater outlet in regenerative cycles remain relatively high. Relatively high temperature allows utilization of remained thermal energy in sequentially located units.

To improve S—$CO_2$ system efficiency, a simple sequential arrangement of at least two independent S—$CO_2$ systems is possible (e.g., in series one after another within a gas flow with waste heat). In the sequential arrangement, the second S—$CO_2$ regenerative cycle utilizes the heat downstream to the first regenerative cycle providing noticeable higher net efficiency of the waste heat utilization arrangement as a whole.

From the state of the art (e.g., WO2012074905A2 and WO2012074911A2), more complex sequential arrangements of two S—$CO_2$ systems are known. The two sequentially arranged regenerative S—$CO_2$ systems in a heat utilizing unit, described in the state of the art, include one common/merged cooler. An advantage is a reduction of components, because only one cooler is required. The system complexity rises and the control gets more complicated because mass flow is to be internally distributed between two turbines and united in a single cooler. In WO2012074905A2, pumps are used assuming liquefied $CO_2$ flow subsequently to the cooler. In WO2012074911A2, compressors are used assuming a supercritical $CO_2$ gas flow subsequently to the cooler.

A further integration is achieved joining the heaters into a single unit (e.g., as described in WO2011119650A2 and O2012074940A3). Both layouts of regenerative S—$CO_2$ systems include two expansion turbines, two recuperators, but just one joint heater, one joint cooler, and one pump for liquid $CO_2$ flow. There are less components than in the systems described above, but the layouts require more complex flow management. Two flow streams are joined at one point of the system and split up back to separate streams at another point of the system upstream.

In WO2011119650A2, the flow stream is split up after a pump, and one flow portion is directly forwarded to a waste heat exchanger. In WO2012074940A3, the flow, before split up, passes through a recuperator placed downstream the pump and only after that the flow portion is entering the waste heat exchanger.

The above described different layouts of S—$CO_2$ system arrangements differ in thermodynamic processes, exhibit different efficiencies, include different hardware components, and demand different system mass flow management and control requirements. A reduction of components requires an increased effort for mass flow management and control. Savings from components lead to increased costs for control and higher complexity with potentially increased error rate.

SUMMARY AND DESCRIPTION

The scope of the present invention is defined solely by the appended claims and is not affected to any degree by the statements within this summary.

The present embodiments may obviate one or more of the drawbacks or limitations in the related art. For example, the present embodiments provide an arrangement and method for the utilization of waste heat with a high efficiency that may be used to utilize little amounts of waste heat at only slightly higher temperatures than in the environment and may be used at different temperatures. The arrangement and method according to the present embodiments provide a simple, cost effective way to utilize waste heat, with a more simple arrangement.

The arrangement for the utilization of waste heat according to the present embodiments includes at least a waste heat exchanger, at least two turbines, at least two recuperators, and at least a cooler unit in at least one fluid circuit. A pump and compressor in one device is further included by an arrangement switchable between a pump and compressor function by a change of the rotational frequency of a rotor of the device.

At a lower frequency of the rotor, the device works as pump, sucking the fluid to the device. At a higher frequency of the rotor, the device works as compressor, pushing the fluid in the fluid circuit to keep the fluid flowing. The combined pump/compressor device allows for a more effective operation in a wider range of environmental and working temperature conditions than devices known from the state of the art. The combined pump/compressor allows a high efficiency of the arrangement that may be used to utilize little amounts of waste heat at only slightly higher temperatures than in the environment. The arrangement also utilizes higher amounts of waste heat at high temperatures. The use of the pump/compressor in one device allows a simple, cost effective layout.

At least two recuperators may be arranged in series (e.g., downstream of the at least one fluid circuit). The use of two recuperators further increases the amount of utilized waste heat and increases the efficiency of the arrangement.

A recuperator may be arranged, respectively, next to a turbine downstream in a fluid cycle (e.g., a recuperator may be arranged next to every turbine). The recuperator uses the heat coming from the turbine to recuperative heat of cycle fluid coming from the pump/compressor. The use of one recuperator next to every turbine allows increasing the efficiency of the arrangement.

Exactly one cooler unit may be included by the arrangement (e.g., in between the last recuperator in series downstream in the at least one fluid circuit and the one pump/compressor device). The use of just one cooler unit simplifies the layout of the arrangement and saves costs and space by reducing the number of components.

A bypass valve may be included by the arrangement, to fluidically bridge at least one turbine. For example, every turbine in the at least one fluid circuit may be bridged by a respective bypass valve. The valve may be controlled or regulated manually or automatically. Depending on the amount of waste heat (e.g., changing with time), and the temperature at the respective turbine, a turbine may be bridged if waste heat is not enough to effectively utilize the waste heat with the turbine. The arrangement may be adjusted to the amount of waste heat and kept at the most effective working level.

The at least one fluid circuit may include exactly one waste heat exchanger. The waste heat exchanger is the largest and most expensive component. Just using one waste heat exchanger may save costs and gives a simple, small arrangement.

The at least one fluid circuit may include, alternatively, more than one waste heat exchanger (e.g., two or three waste heat exchangers). The waste heat exchangers may be arranged one after another in a waste heat stream coming from the waste heat source. The serial arrangement may lead to an increase in the amount of waste heat utilized by the arrangement and to an increase of its effectiveness.

The arrangement may be a regenerative supercritical $CO_2$ system (e.g., with $CO_2$ as working fluid within the at least one fluid circuit). Systems including supercritical $CO_2$ as working fluid, also called S—$CO_2$ systems, may utilize waste heat even at very low temperatures above the environmental temperature and utilize even small amounts of waste heat very effectively. Very low temperatures may be just some degree Celsius, and the utilization may be performed up to some hundred degrees Celsius with the same arrangement.

The at least one fluid circuit may be in form of a closed cycle. With a closed cycle, a very high efficiency may be reached, with no contamination of the environment. The working fluid is not lost or does not have to be replaced all the time, saving costs and effort. Working fluids like in S—$CO_2$ systems may be used.

One turbine (e.g., every turbine) may be, respectively, mechanically connected to at least one generator. In the working fluid stored, waste heat is converted to mechanical energy by the turbine and the respective mechanically connected generator, which converts the mechanical energy to electrical energy.

The method for the utilization of waste heat according to the present embodiments (e.g., with an arrangement described above) includes at least a waste heat exchanger heating up a fluid with heat from a waste heat source, the heated fluid flowing through a first set of at least one turbine and recuperator, and downstream flowing through at least a second recuperator fluidically connected to at least a second turbine via a fluid junction upstream before the at least one second recuperator (e.g., flowing downstream through at least a third recuperator fluidically connected to at least a third turbine via a fluid junction upstream before the at least one third recuperator).

The fluid may flow downstream after the recuperators through a cooler unit (e.g., exactly one cooler unit) and further downstream through a pump and compressor in one device, switchable between the pump and compressor function by a change of the rotational frequency of a rotor of the device.

The fluid may be flowing downstream after the pump and compressor in one device through the recuperators, and may be heated up by the fluid flow coming (e.g., directly coming) from a turbine.

The fluid may be heated up in exactly one waste heat exchanger by exhaust (e.g., stored in a fluid coming from an exhaust source).

Alternatively, the fluid may be heated up in more than one waste heat exchanger by exhaust (e.g., stored in a fluid coming from an exhaust source, with the waste heat exchangers arranged in series in the exhaust fluid stream one after another).

The advantages achieved by the described method for the utilization of waste heat according to the present embodiments are similar to the previously described arrangement for the utilization of waste heat and the described advantages described above, and vice versa.

DETAILED DESCRIPTION

Figure 1:
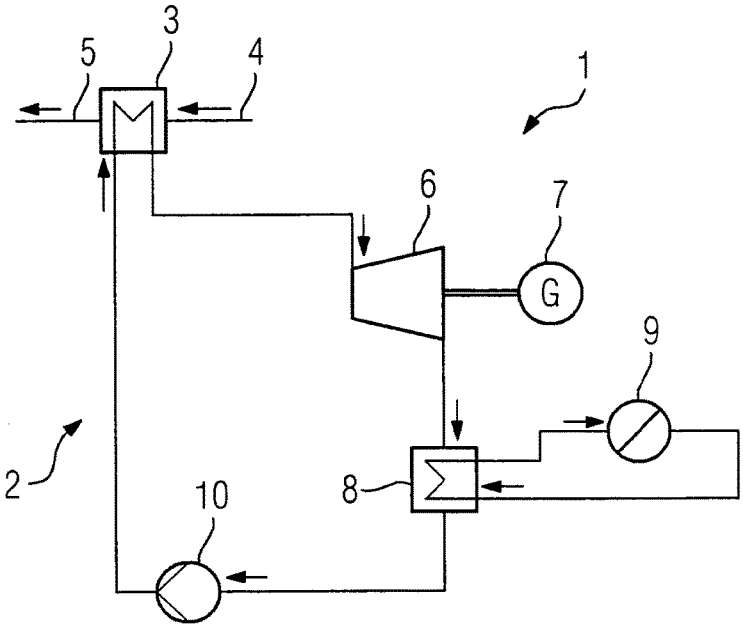
FIG. 1 depicts a non-regenerative arrangement from the state of the art for the utilization of waste heat with supercritical $CO_2$.

In FIG. 1, a non-regenerative arrangement 1 from the state of the art for the utilization of waste heat with supercritical $CO_2$ in a fluid cycle 2 is depicted. Exhaust in a fluid stream (e.g., air) coming from a waste heat source is flowing through a waste heat exchanger 3. For example, a waste heat source is a machine or industrial process with heat production. The fluid cycle 2 includes the waste heat exchanger (e.g., filled with supercritical $CO_2$ as heat transporting fluid, further described as fluid or working fluid). The fluid absorbs heat from the exhaust within the heat exchanger and changes temperature from a first temperature $T_1$ to a higher, second temperature $T_2$. For example, the first temperature $T_1$ is room temperature, and the second temperature $T_2$ is in the range of 100° C. to 200° C. The second temperature may also be lower or higher, depending on the temperature of the exhaust.

The heated fluid in cycle 2 is flowing to a turbine 6 included in the cycle 2. The turbine 6 transforms thermal energy of the fluid into mechanical energy, cooling down the fluid. The turbine 6 is mechanically connected with a generator 7 that transforms the mechanical energy of the turbine 6 into electrical energy.

The fluid, coming from the turbine 6, flows through a cooler 8 thermally connected with a heat sink 9 (e.g., a dry fan or wet tower). The cooler 8 cools the fluid further down (e.g., substantially to temperature $T_1$). A pump 10 in the fluid cycle 2 pumps the fluid back to the waste heat exchanger 3 and generates the fluid flow in cycle 2. Alternatively, a compressor 10 may be used instead of the pump.

Figure 2:
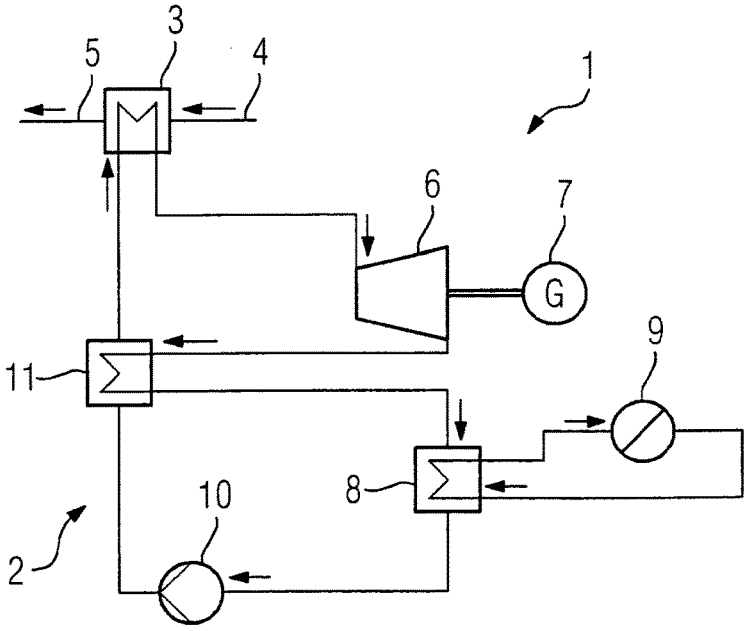
FIG. 2 depicts a regenerative arrangement from the state of the art for the utilization of waste heat with supercritical $CO_2$.

In FIG. 2, an arrangement from the state of the art for the utilization of waste heat with supercritical $CO_2$ is depicted (e.g., as in FIG. 1), just with regenerative layout. The cycle 2 is as in FIG. 1, also including a recuperator 11. The recuperator 11 is arranged in the fluid flow between the turbine 6 and the cooler 8, in thermal connection with fluid flowing to the waste heat exchanger 3 after the pump or compressor 10. The residual heat after turbine 6 is regenerated in the recuperator 11. The fluid coming from pump or compressor 10 is heated within the recuperator 11.

The arrangements 1 with the closed cycle 2 of FIGS. 1 and 2 are effectively able to utilize about 10% of waste heat of the exhaust from the waste heat source. For higher efficiencies, more complex arrangements are necessary.

Figure 3:
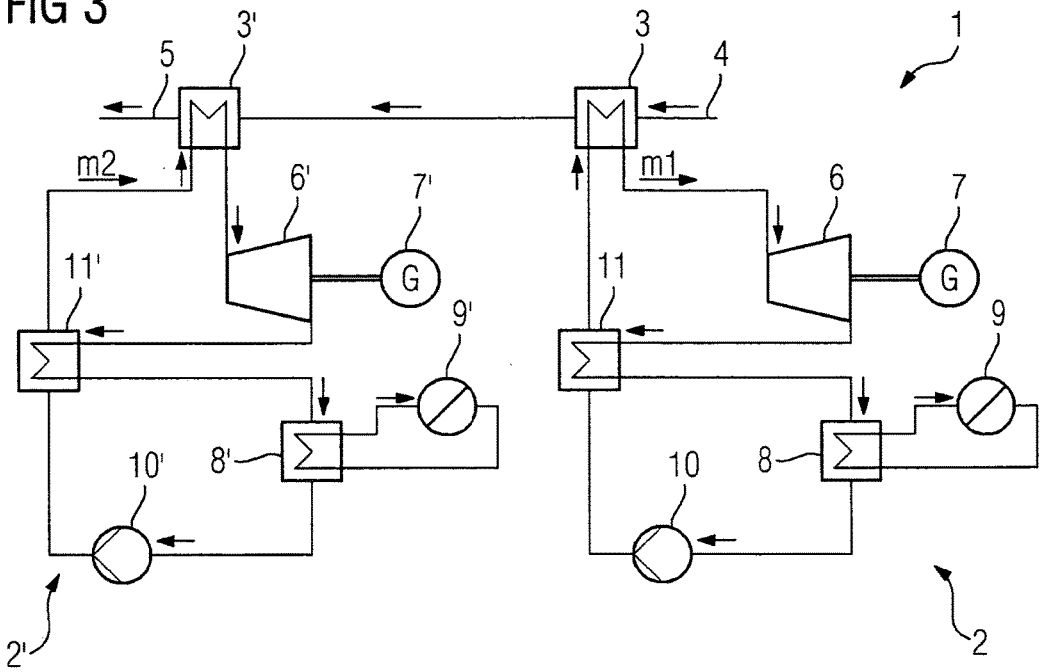
FIG. 3 depicts a regenerative arrangement for the utilization of waste heat of two closed, independent cycles with supercritical $CO_2$, one behind the other within a steam of exhaust.

In FIG. 3, a simple arrangement of two independent waste heat utilization systems similar to the one of FIG. 2 is depicted, with two closed, independent cycles 2. Every cycle includes waste heat exchangers 3, 3' arranged in the exhaust stream next to each other, one exchanger 3' after the other exchanger 3 in a line in the stream direction. For systems with working medium/fluid S—$CO_2$ as fluid in the cycle 2, even at lower temperatures of exhaust in the second waste heat exchanger 3', waste heat may be utilized. The system is able to effectively utilize about 20% of waste heat from the waste heat source. A disadvantage of this arrangement is the high price and space consumed by the arrangement 1, because all components in two independent, not interconnected working fluid circuits of the system are at least twice provided.

Figure 4:
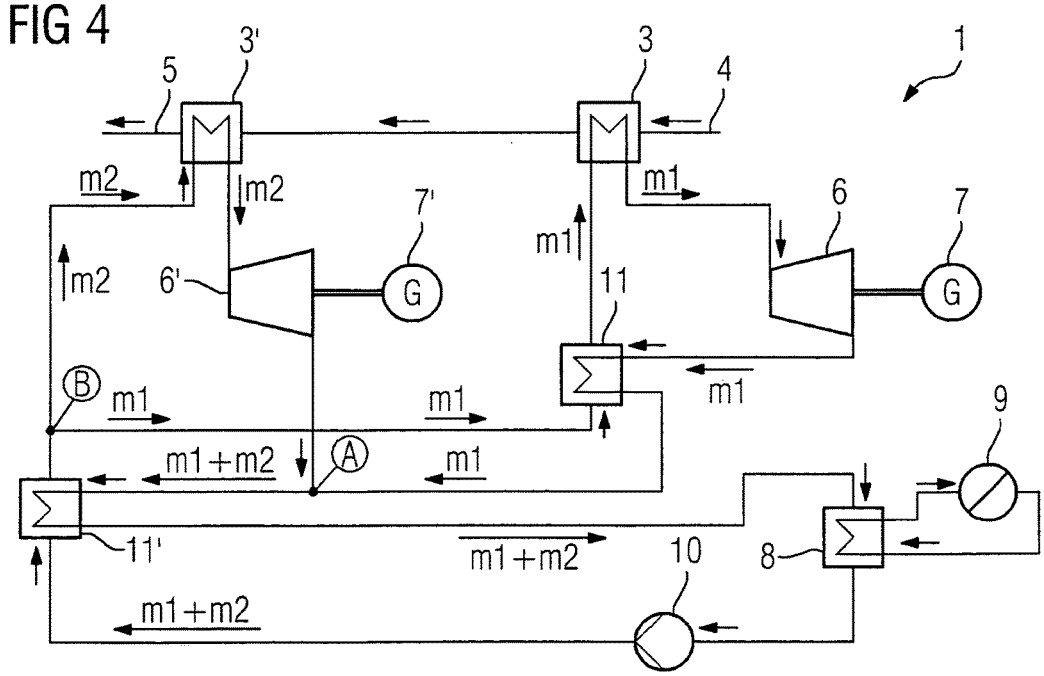
FIG. 4 depicts a regenerative arrangement for the utilization of waste heat with one pump/compressor device according to the present embodiments and with two waste heat exchangers in a circuit with one cooler and two turbine recuperator pairs.

In FIG. 4, a regenerative arrangement 1 according to one or more of the present embodiments is provided for the utilization of waste heat with one pump/compressor device 10. The arrangement includes two waste heat exchangers 3 in an interconnected working fluid circuit with two turbine 6, 6' recuperator 11, 11' pairs, one cooler 8, and one pump/compressor device 10. Every turbine 6, 6' is mechanically connected to a generator 7, 7', respectively, to convert mechanical energy of the turbine 6, 6' to electrical energy. The cooler 8 is connected to a heat sink 9 (e.g., a dry fan or a wet tower) by a closed fluid circuit. The heat from the working fluid is transferred from the cooler 8 to the heat sink 9 and from the heat sink 9 to the environment, cooling down the working fluid of arrangement 1 in the cooler 8.

The working fluid in the waste heat exchangers 3 is receiving and storing an amount of heat from the exhaust that comes from the waste heat source not depicted in the figure for simplicity. The exhaust fluid is streaming into the first waste heat exchanger 3 through an input in direction 4, passing by a heat exchanger unit (e.g., in plate or spiral form), filled with the working fluid that is included by a fluid circuit. The working fluid absorbs heat from the exhaust, and the exhaust fluid is flowing out of the first waste heat exchanger 3 (e.g., in direction 5) in a cooled down state. In the exhaust fluid flow downstream of the first waste heat exchanger 3, a second waste heat exchanger 3' is arranged. For example, the second waste heat exchanger 3' is constructed and functions like the first waste heat exchanger 3, further cooling down the exhaust. The exhaust in a cooled down state is released from the second waste heat exchanger 3' to the environment. Waste heat from the exhaust is absorbed to and stored in the working fluid passing the waste heat exchangers 3, 3'.

The arrangement 1 as depicted in FIG. 4, with one waste heat exchanger 3 (e.g., using supercritical $CO_2$ as working fluid in the circuit), may use substantially up to 10% of waste heat coming from the waste heat source. For example, in the first waste heat exchanger 3, exhaust with a temperature in the range of some hundred degree Celsius may be cooled down to 100 to 200° C., and in the second waste heat exchanger 3', the exhaust may be cooled further down to substantially 20° C. (e.g., room temperature).

The arrangement 1 as depicted in FIG. 4, with two waste heat exchangers (3, 3'), may use substantially up to 20% of waste heat from the exhaust.

The working fluid, coming from the waste heat exchanger 3 loaded with heat, flows in the fluid circuit to the turbine 6 (e.g., with a first mass flow m1). The turbine 6 is mechanically connected to a generator 7. Energy, stored in the working fluid in form of heat (e.g., the working fluid has a higher temperature $T_2$ than just before the waste heat exchanger with temperature $T_1$), is transformed into mechanical energy by the turbine 6 and to electrical energy by the generator 7. Normally, the turbine 6 may use substantially up to 12% of waste heat from the exhaust to produce electricity.

From the turbine 6, the working fluid is flowing to a recuperator 11 within the circuit. The recuperator 11 regenerates the heat of working fluid downstream the turbine 6 and cools the working fluid down at this point between turbine 6 and a cooler 8.

From the recuperator 11, the working fluid flows to a joint at point A.

The working fluid, coming from the second waste heat exchanger 3' loaded with heat, flows in a second branch of the fluid circuit to the second turbine 6' (e.g., for with a second mass flow m2). The turbine 6' is mechanically connected to a generator 7'. Energy, stored in the working fluid in form of heat from waste heat exchanger 3', is transformed into mechanical energy by the turbine 6' and to electrical energy by the generator 7'. Normally, the turbine 6' may use substantially up to 8% of waste heat from the exhaust to produce electricity.

Coming from the turbine 6', the working fluid with the second mass flow m2 is flowing to the joint at point A. At the joint at point A, working fluid coming from turbine 6 and passed through recuperator 11 with mass flow m1 is converged with working fluid coming from the second turbine 6' with mass flow m2. The converged fluid flow with mass flow m1 plus m2 is flowing to and through a second recuperator 11'. The recuperator 11' further regenerates the heat of working fluid (e.g., the parts coming from turbine 6' and recuperator 11), and cools the working fluid down at this point between turbine 6', recuperator 11, and a cooler 8.

In cooler 8, the working fluid is further cooled down. In general, a cooler 8 is thermally connected to a heat sink 9 (e.g., a dry fan or a wet tower), building up a cooling unit. The cooler may be a heat exchanger connected via a fluid cycle to the heat sink 9. Other cooling devices and layouts may also be provided.

From the cooling device 8, the working fluid flows to a pump/compressor unit 10 according to one or more of the present embodiments. Depending on the temperature of the working fluid, the pump/compressor unit 10 may be operated as pump (e.g., pumping liquefied S—$CO_2$ working fluid), or may be operated as compressor (e.g., compressing S—$CO_2$ working fluid in gas phase). The switching of the unit 10 from pump to compressor mode occurs by a change of the rotational frequency of a rotor in the unit 10. At a lower frequency, the pump/compressor unit 10 may operate as pump and at higher frequency, the pump/compressor unit 10 may operate as a compressor (e.g., of supercritical fluid). The switching may be performed automatically or by hand. For example, the switching may also be controlled or regulated by a computer (e.g., in connection with sensors, such as temperature, phase and/or pressure sensors).

A pump/compressor unit 10 with both functionalities (e.g., pump and compressor functions) allows for more effective operation of systems (e.g., with S—$CO_2$ as working fluid) in a wide range of environmental temperature conditions. If the environmental temperature is low enough to cool down the working fluid (e.g., $CO_2$ to 15 to 20° C.) and to liquefy the working fluid, the unit 10 may operate with high efficiency but as pump. At other environmental temperatures that are higher, where it is not possible to liquefy the working fluid (e.g., $CO_2$), the unit 10 works as a compressor for the supercritical working fluid to be moved within the fluid circuit.

From the pump/compressor unit 10, the working fluid with mass flow m1 and m2 is passing the recuperator 11'. The recuperator 11' works as a heat exchanger. The recuperator 11' cools down the working fluid coming from turbine 6' and recuperator 11, and flowing to cooler 8, heats up working fluid coming from the pump/compressor unit 10 to substantially a temperature of working fluid just before the waste heat exchanger 3'.

At a joint at point B, the mass flow m1 and m2 is split into two parts. The working fluid coming from recuperator 11' is split into a part m2, flowing into the branch to the waste heat exchanger 3', and into a part m1, flowing to recuperator 11. Recuperator 11 works like recuperator 11' and cools down the working fluid coming from turbine 6, and flowing to cooler 8 via recuperator 11', and further heating up working fluid coming from the pump/compressor unit 10 via recuperator 11' and point B to substantially raise a temperature of working fluid just before the waste heat exchanger 3. At the waste heat exchangers 3, 3', the working fluid circuit is closed, starting from the beginning as described before. The temperature of working fluid just before the waste heat exchanger 3 is in general higher than the temperature just before the waste heat exchanger 3'.

The layout of the arrangement 1 with a closed working fluid circuit, partly split into two branches between point A and B with, respectively, a waste heat exchanger 3, 3' and a turbine 6, 6' generator 7, 7' pair, joined together to be cooled down by one cooler 8 and fluidically driven by one pump/compressor unit 10, uses waste heat effectively with a reduced number of components at different environmental temperatures. As depicted in FIG. 4, the two branches of the working fluid circuit are in parallel between points A and B, with, respectively, a waste heat exchanger 3, 3' and a turbine 6, 6' generator 7, 7' pair.

The waste heat exchangers 3, 3' are arranged one after another in the exhaust fluid downstream, for example, in series. The first waste heat exchangers 3, in combination with turbine 6, may utilize substantially 12% of waste heat at a higher temperature (e.g., between 200 and 300° C.), and the second waste heat exchangers 3', in combination with turbine 6', may utilize substantially further 8% of waste heat at a lower temperature (e.g., below 100° C. down to less than 20° C., room temperature). Other arrangements 1 are also possible (e.g., with parallel waste heat exchangers 3, 3'), but not depicted in the figure for simplicity. Temperatures are dependent on the exhaust and the arrangement 1. In the parallel arrangement 1 of waste heat exchangers 3, 3', for example, temperatures of exhaust at both exchangers 3, 3' may be similar.

The second branch of the circuit fluid cycle, with turbine 6' as depicted in FIG. 4, utilizes heat that was not utilized within the first branch with turbine 6. This is realized with turbine 6' by using the waste heat exchangers 3 and 3' in a line (e.g., one after another) in the waste heat stream parallel to the stream direction, and by using two recuperators 11 and 11' in the working fluid circuit. High temperature recuperator 11 provides heat transfer from working fluid m1, coming from turbine 6, to working fluid m1, flowing to waste heat exchanger 3, preheating working fluid m1 flowing to the waste heat exchanger 3 using waste heat stored in the working fluid from turbine 6. Low temperature recuperator 11' provides heat transfer from working fluid m1 and m2, including fluid with lower temperature than m1 coming from turbine 6.

Waste heat is stored in fluid coming from turbine 6', and the rest of the heat is stored in the working fluid leaving the recuperator 11 coming from turbine 6. The heat is transferred in recuperator 11' to working fluid m1 and m2 coming from the pump/compressor unit 10, pre-heating the working fluid before the split up in point B. In Point B, mass flow m1 and m2 is split up to mass flow m1, entering the recuperator 11 downstream, and mass flow m2, entering waste heat exchanger 3' downstream. This layout of the arrangement not only increases the efficiency by using two waste heat exchangers 3, 3' one after another, but also by regenerating the working fluid in two recuperators 11, 11' one after another within the working fluid stream.

In one embodiment, in combination with the use of S—$CO_2$ as working fluid and use of more than one waste heat exchanger, a high efficiency of more than 20% utilization of waste heat may, for example, be reached. The use of one unit 10, combining a pump and compressor in one unit, and one cooler 8 provides a simple, cost effective arrangement 1. The combination of pump and compressor function in unit 10 enables the utilization of waste heat at a wide range of environmental temperatures and in a two stage arrangement 1 with two waste heat exchangers 3, 3' and two recuperators 11, 11', respectively, in series in the fluid streams. The waste heat exchangers (3, 3') are in series in the exhaust stream, and the recuperators 11, 11' are in series in working fluid stream.

Figure 5:
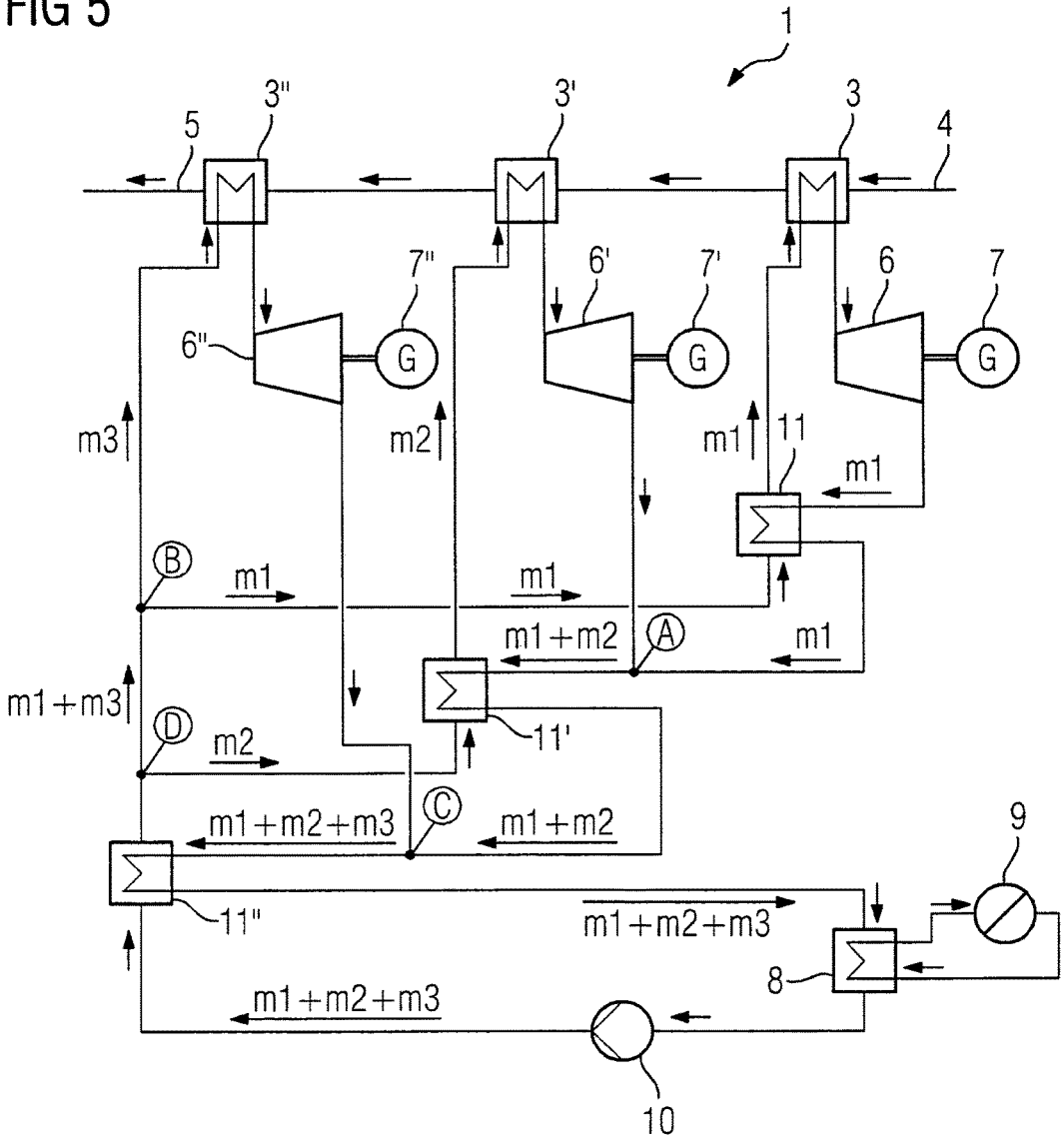
FIG. 5 depicts a regenerative arrangement 1, as in FIG. 4, including three waste heat exchangers, one behind the other within the steam of exhaust, in a circuit with one cooler and three turbine recuperator pairs.

In FIG. 5, an arrangement 1 like in FIG. 4 is depicted, but with three waste heat exchangers 3, 3', 3" and three recuperators 11, 11', 11" instead of two, respectively, further increasing the efficiency from more than 20% to more than 22%. The principle arrangements of FIGS. 4 and 5 are the same, but in FIG. 5, the working fluid coming from the second recuperator 11' is not flowing directly to the cooler 8 but to a joint in point C and further through a third recuperator 11", and then to the cooler 8 and pump/compressor unit 10.

At the joint at point C, working fluid with a mass flow m3 is arriving, coming from a third branch of the fluid circuit parallel to the two other branches, as depicted in FIG. 4, where the third branch includes a third waste heat exchanger 3" in line downstream in the waste heat stream to the first two waste heat exchangers 3, 3' in the other branches, and includes a third turbine 6' generator 7' pair. At point C, working fluid from the first two branches with mass flow m1 and m2 converges with working fluid coming from the third turbine 6' with mass flow m3. The third recuperator 11" exchanges waste heat, stored within the working fluid (e.g., left coming from the turbine 6' and left after the first two recuperators 11, 11'), and heats up working fluid coming from the pump/compressor unit 10.

Downstream from recuperator 11" at point D, the working fluid stream m1, m2, and m3 is split up in a joint into a working fluid stream with mass flow m2, flowing to the second recuperator 11' downstream, and a working fluid stream with mass flow m1 and m3. Downstream recuperator 11" and point D, the working fluid stream with mass flow m1 and m3 is split up at point B in a joint into a working fluid stream with mass flow m3 and into a working fluid stream with mass flow m1. The working fluid with mass flow m3 is flowing into the third branch to waste heat exchanger 3", closing the circuit within the third branch, further flowing to turbine 6" again. The working fluid with mass flow m1 is flowing into the first branch to recuperator 11 and further downstream to the waste heat exchanger 3, closing the circuit within the first branch, further flowing to turbine 6 again.

The arrangement 1 in FIG. 5 has the same advantages as arrangement 1 in FIG. 4, but further increases the efficiency in case of high temperature differences between the environment and exhaust temperature. The use of three waste heat exchangers 3, 3', 3" in combination with three turbines 6, 6', 6" and three recuperators 11, 11', 11" increases the amount of utilized waste heat. The use of a common cooler 8 and a common pump/compressor unit 10 in the circuit reduces costs and leads to a simplified arrangement with less components, consuming less space. The pump/compressor in one unit 10 allows the utilization of waste heat at different (e.g., changing) temperatures of the waste heat stream and changing temperatures in the environment (e.g., by using S—$CO_2$ as working fluid in the closed circuit).

Figure 6:
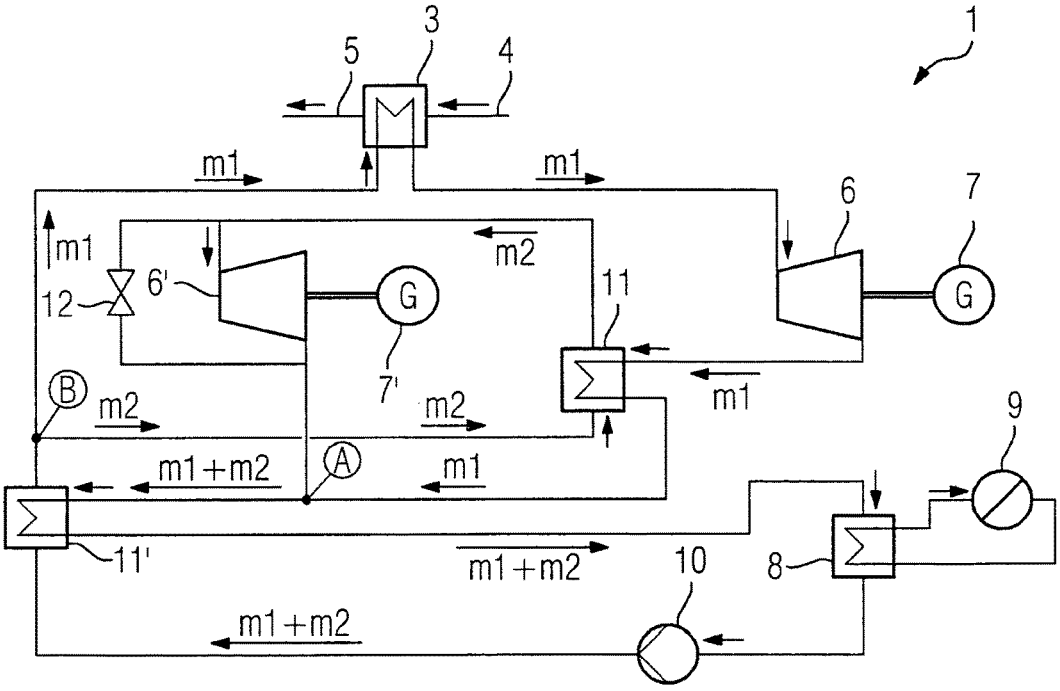
FIG. 6 depicts a regenerative arrangement 1 as in Figure with only one waste heat exchanger.

In FIG. 6, a regenerative arrangement 1 as in FIG. 4 is depicted, but with only one waste heat exchanger 3 instead of two waste heat exchangers (3, 3'). This leads to a reduction of components, size and costs. The waste heat exchanger is the most expensive and largest part of arrangement 1. Merging the two waste heat exchangers 3, 3' of FIG. 4 into one waste heat exchanger 3, in the embodiment of FIG. 6, enables the utilization of a high amount of waste heat with reduced costs and size.

As in FIG. 4, there are two branches of the working fluid circuit in the arrangement 1 of FIG. 6. The output of recuperator 11 downstream, however, is not, like in FIG. 4, directly fluidically connected to the waste heat exchanger 3, but instead to the input of turbine 6'. The second branch includes no waste heat exchanger 3'. The output of waste heat exchanger 3 in FIG. 6, which corresponds to the waste heat exchanger 3' in FIG. 4, is directly fluidically connected to turbine 6, and is included by branch one instead of branch two as in FIG. 4.

A bypass with valve 12 to the turbine 6' may be used to fluidically bypass and/or fluidically switch off turbine 6' (e.g., if the amount of waste heat stored in the working fluid is low). If the amount of waste heat is too low to be used by turbine 6', the bypass valve 12 may be opened, and the fluid flow with mass m2 is flowing through the bypass instead through turbine 6'. The turbine 6' is in a switched off state. By closing the valve 12, the state may be changed to a switched on state, and working fluid with mass flow m2 is flowing through turbine 6', which is mechanically connected to generator 7', converting heat energy to mechanical energy by the turbine and further to electrical energy by the generator. Other functionalities of arrangement 1 in FIG. 6 are as described in principal for the arrangement 1 of FIG. 4.

Figure 7:
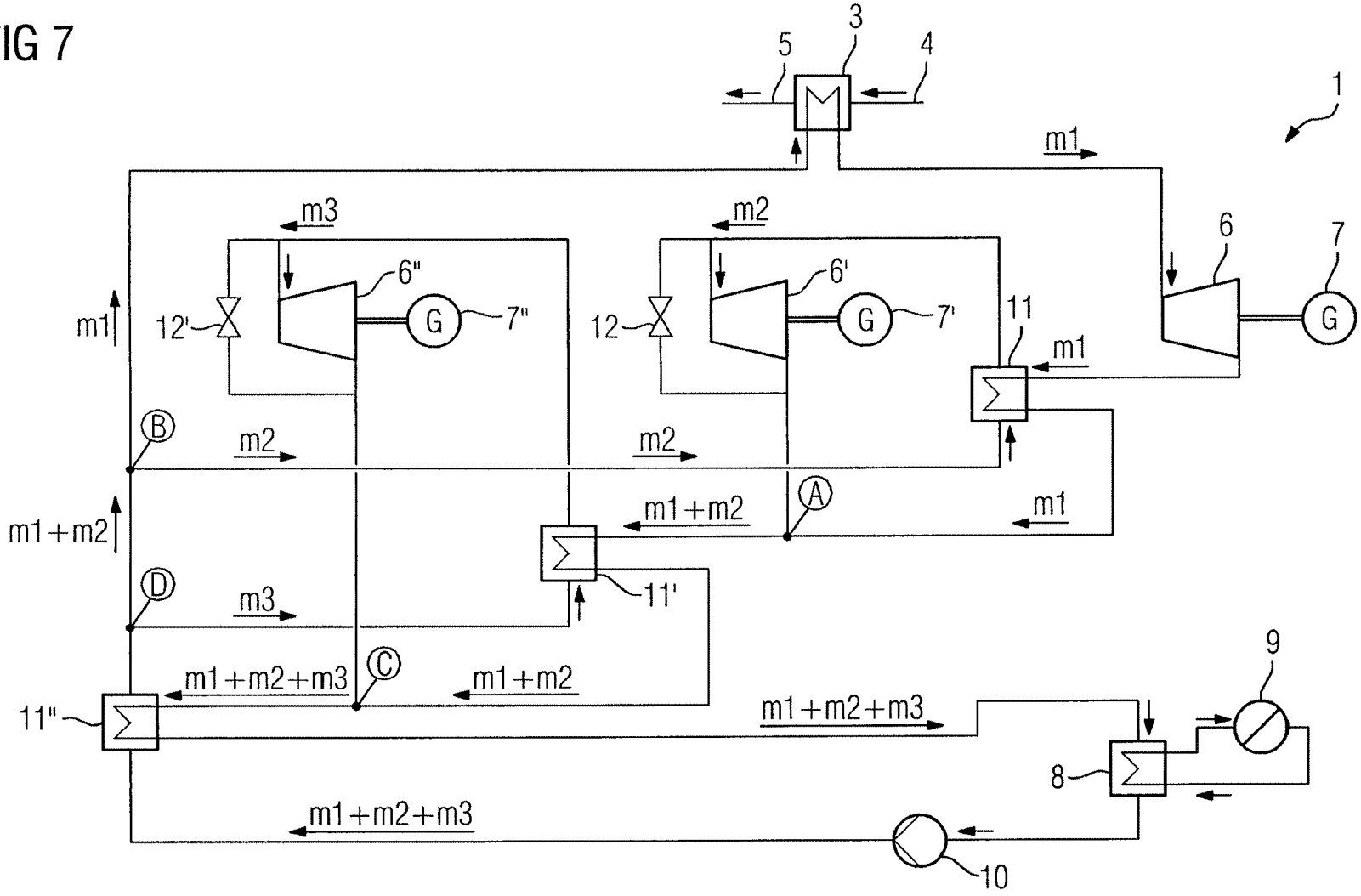
FIG. 7 depicts a regenerative arrangement—as in Figure with only one waste heat exchanger.

As depicted in FIG. 7, the arrangement 1 of FIG. 6 may include three branches, respectively with a turbine 6, 6', 6" generator 7, 7'," pair. The layout and operation in general of arrangement 1 in FIG. 7 includes components as described for FIG. 6 compared to FIG. 4, with differences according to the embodiment of FIG. 5. In FIG. 7, the hot side outflows of the working fluid from respective recuperators 11, 11' downstream are connected to the inlets for working fluid of the respective turbines 6' and 6", which are arranged in neighboring branches of the fluid circuit. In the embodiment of FIG. 5, the waste heat exchangers 3', 3" are instead fluidically connected to the inlets of respective turbines 6' and 6". In the embodiment of FIG. 7, only the circuit branch with turbine 6 includes a waste heat exchanger 3.

Turbines 6' and 6" may be in a switched off state by using a bypass with valve 12, 12', respectively, as described for turbine 6' in FIG. 6. Depending on the amount of waste heat to utilize and the temperature of the environment, the branches and turbines 6' and 6" may be used or switched off.

In summary, the arrangements 1 of FIGS. 4 to 7 according to the present embodiments include a common pump/compressor unit 10. As depicted in FIGS. 4 to 7, the arrangements also include a common cooler 8 with heat sink 9. The pump/compressor unit 10, depending on temperature and phase of the working fluid, may work as compressor or pump with the advantages as described before. The use of common devices reduces the number of components, costs, and size of the arrangement 1. By using, for example, S—$CO_2$ as working fluid, a high efficiency may be reached due to heat recovery by recuperators 11, 11', 11" in a wide range of temperatures. Different turbines 6, 6', 6" in, for example, parallel branches (e.g., may be in a switched on or off mode) allow for the utilization of different amounts of waste heat at different temperatures. The amount of waste heat to be utilized in sum is higher in the described embodiments compared to using just one turbine 6. The simplified layout, control, and/or regulation of fluid and the possibility to utilize waste heat at a wide range of temperature, even with temperature changes, are particular advantages of the present embodiments.

The above described features of the present embodiments may be combined with each other and/or may be combined with embodiments known from the state of the art. For example, more than three branches may be used for the arrangement. Supercritical or normal fluids may be used as working fluid (e.g., oil, water, steam, halogens, etc.). Branches may be used without a recuperator, depending on the working fluid in use. Further components may be included by the arrangement 1, such as additional valves to control or regulate the fluid flow at special points of the working fluid circuit.

The absence of points in the layout splitting up the fluid flow in the upstream direction simplifies the design and simplifies the control or regulation requirements for the fluid flow. Additional bypass valves may be used to respond to variations of exhaust temperature and flow rate as to other environmental parameters. Downstream branches of the working fluid circuit may be turned off with bypass valves. Turning off downstream branches allows a fluid stream to be adjusted to component/device dimensions. There are no upstream fluid nodes in the design according to the present embodiments splitting the fluid steam in upstream direction. All nodes (e.g., at points A, B in FIGS. 4 and 6, and A, B, C, D in FIGS. 5 and 7) are splitting up the fluid flow in downstream direction.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A system for utilization of waste heat, the system comprising:

a waste heat exchanger;

at least three turbines comprising at least one first turbine, at least one second turbine and at least one third turbine;

at least three recuperators comprising at least one first recuperator, at least one second recuperator and at least one third recuperator;

at least one cooler unit in at least one fluid circuit; and a pump and a compressor in one device, wherein the one device is configured to be switchable between a pump and compressor function by a change of a rotational frequency of a rotor of the one device, wherein the system is configured to heat up a working fluid with heat from a waste heat source, the heated working fluid configured to flow through a first set of the at least one first turbine and at least one first recuperator, the heated working fluid further configured to flow downstream through the at least one second recuperator fluidically connected to the at least one second turbine via a fluid junction upstream before the at least one second recuperator, the heated fluid configured to flow downstream through the at least one third recuperator fluidically connected to the at least one third turbine via a fluid junction upstream before the at least one third recuperator, wherein the working fluid is configured to flow downstream after the at least three recuperators through the at least one cooler unit and further downstream through the pump and compressor in the one device.

2. The system of claim 1, wherein the at least one fluid circuit comprises exactly one waste heat exchanger.

3. The system of claim 1, wherein the system is a regenerative supercritical $CO_2$ system.

4. The system of claim 1, wherein the at least one fluid circuit comprises a closed cycle.

5. The system of claim 1, wherein the at least three recuperators are arranged in series.

6. The system of claim 5, wherein the at least three recuperators are arranged downstream of the at least one fluid circuit.

7. The system of claim 1, wherein one of the at least three recuperators is arranged next to one of the at least three turbines downstream in a fluid cycle.

8. The system of claim 7, wherein each recuperator of the at least three recuperators is arranged next to a respective turbine of the at least three turbines.

9. The system of claim 1, wherein the at least one cooler unit comprises exactly one cooler unit.

10. The system of claim 9, wherein the one cooler unit is provided between a last recuperator in series downstream in the at least one fluid circuit, and the one device.

11. The system of claim 1, further comprising a bypass valve configured to fluidically bridge at least one turbine of the at least three turbines.

12. The system of claim 11, wherein every turbine in the at least one fluid circuit is bridged by a bypass valve.

13. The system of claim 1, wherein the at least one fluid circuit comprises more than one waste heat exchanger.

14. The system of claim 13, wherein the at least one fluid circuit comprises two or three waste heat exchangers.

15. The system of claim 1, wherein one turbine of the at least three turbines is mechanically connected to at least one generator.

16. The system of claim 15, wherein every turbine of the at least three turbines is respectively mechanically connected to at least one generator.

17. A method for utilization of waste heat with at least a waste heat exchanger, the method comprising:

heating up a working fluid with heat from a waste heat source, the heated working fluid flowing through a first set of at least one first turbine and first recuperator, and flowing downstream through at least a second recuperator fluidically connected to at least a second turbine via a fluid junction upstream before the at least one second recuperator, the heated fluid flowing downstream through at least a third recuperator fluidically connected to at least a third turbine via a fluid junction upstream before the at least one third recuperator, wherein the working fluid flows downstream after the first, second, and third recuperators through a cooler unit and further downstream through a pump and compressor in one device, the one device being switchable between the pump and compressor function by a change of a rotational frequency of a rotor of the one device.

18. The method of claim 17, wherein the working fluid is flowing downstream after the pump and compressor in one device through the first, second, and third recuperators, and is heated up by the fluid flow coming directly from a turbine of the at least one first turbine, the second turbine, and the third turbine.

19. The method of claim 17, wherein the working fluid is heated up in exactly one waste heat exchanger by an exhaust source.

20. The method of claim 19, wherein the working fluid is heated up in the exactly one waste heat exchanger by heat stored in an exhaust fluid coming from the exhaust source.

21. The method of claim 17, wherein the working fluid is heated up in more than one waste heat exchanger by an exhaust source.

22. The method of claim 21, wherein the working fluid is heated up in the more than one waste heat exchanger by heat stored in an exhaust fluid coming from the exhaust source, the waste heat exchangers being arranged in series in an exhaust fluid stream one after another.

* * * * *